US005377495A

United States Patent [19]

Daigle

[11] Patent Number: 5,377,495

[45] Date of Patent: Jan. 3, 1995

[54] TEMPERATURE CONTROLLED THERMAL JACKET FOR TRANSFERING REFRIGERANT

[76] Inventor: Regis G. Daigle, 8402 E. Stella Rd., Tucson, Ariz. 85730

[21] Appl. No.: 266,194

[22] Filed: Jun. 27, 1994

[51] Int. Cl.[6] ..... F25B 49/00

[52] U.S. Cl. ..... 62/125; 62/149; 62/292; 165/46

[58] Field of Search ..... 62/77, 129, 149, 292, 62/371, 372, 125, 126; 165/46

[56] References Cited

U.S. PATENT DOCUMENTS 5,189,881 3/1993 Miles ..... 62/292

5,233,840 8/1993 Scaringe ..... 62/292

*Primary Examiner*—John Sollecito

[57] ABSTRACT

A temperature controlled thermal jacket for selectively heating and cooling a refrigerant container for capturing refrigerant therefrom and transferring refrigerant thereto comprising a hollow and generally tubular jacket formed of a flexible material adapted to be coupled about a refrigerant container; a fill mechanism coupled to the jacket for filling the jacket with a thermally conductive liquid; a coil of thermally conductive tubing disposed within the jacket with the coil having an inlet and an outlet; and a pump mechanism coupled between the inlet and outlet of the coil for pumping thermally conductive liquid through the jacket.

7 Claims, 6 Drawing Sheets

TEMPERATURE CONTROLLED THERMAL JACKET FOR TRANSFERING REFRIGERANT

BACKGROUND OF THE INVENTION

1. Field of the Invention

The present invention relates to a temperature controlled thermal jacket and more particularly pertains to selectively heating and cooling a refrigerant cylinder for capturing refrigerant therefrom and transferring refrigerant thereto with a temperature controlled thermal jacket.

2. Description of the Prior Art

The use of cooling and heating apparatuses is known in the prior art. More specifically, cooling and heating apparatuses heretofore devised and utilized for the purpose of selectively heating and cooling a refrigerant container are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,131,232 to Uno et al. discloses a cooling method. U.S. Pat. No. 5,156,006 to Broderdorf et al. discloses an apparatus for cooling and heat transfer fluid. U.S. Pat. No. 5,189,890 to Kitayama discloses a portable chiller.

While these devices fulfill their respective, particular objective and requirements, the aforementioned patents do not describe a temperature controlled thermal jacket that may be selectively heated or cooled to recover refrigerant from refrigeration containers.

In this respect, the temperature controlled thermal jacket according to the present invention substantially departs from the conventional concepts and designs of the prior art, and in doing so provides an apparatus primarily developed for the purpose of collectively heating and cooling a refrigerant sealer for capturing refrigerant therefrom and transferring refrigerant thereto.

Therefore, it can be appreciated that there exists a continuing need for new and improved temperature controlled thermal jacket which can be used for collectively heating and cooling a refrigerant sealer for capturing refrigerant therefrom and transferring refrigerant thereto. In this regard, the present invention substantially fulfills this need.

SUMMARY OF THE INVENTION

In the view of the foregoing disadvantages inherent in the known types of cooling and heating apparatuses now present in the prior art, the present invention provides an improved temperature controlled thermal jacket. As such, the general purpose of the present invention, which will be described subsequently in greater detail, is to provide a new and improved temperature controlled thermal jacket and method which has all the advantages of the prior art and none of the disadvantages.

To attain this, the present invention essentially comprises, in combination, a hollow and generally tubular jacket formed of a canvas material for receiving a thermally conductive liquid therein with the jacket further having an upper end, a lower end, a fill hole disposed on the upper and secured with a removable fill cap, a vent hole disposed on the upper end and secured with a removable vent cap, a drain hole disposed on the lower end and secured with a removable drain cap, an elongated slit formed therethrough for allowing the jacket to be spread open and wrapped around a refrigerant cylinder, and a pair of spaced safety wires coupled across the slit for limiting the spread of the jacket. A plurality of rigid aluminum support beams are disposed within the jacket to provide it stability. A plurality of spaced and adjustable belts are coupled to the jacket across the slit thereof with each belt adapted to be secured for ensuring a tight fit about a refrigerant cylinder disposed therein. A generally tubular-shaped coil of thermally conductive copper tubing is disposed within the jacket with the coil wrapped in a configuration to define an opening positioned adjacent to the slit of jacket with the coil adapted to flex when the jacket is spread open and with the coil having an inlet positioned near the lower end of the jacket and an outlet positioned near the upper end of the jacket. A pump is coupled to the coil between the inlet and outlet thereof and secured to the jacket with a pile type fastener with the pump adapted to be electrically energized for pumping thermally conductive liquid through the jacket. A removable porcelain heater fill cap is adapted to be secured to the fill hole in lieu of the fill cap with the heater fill cap having a heating element for heating thermally conductive liquid and a temperature probe for monitoring the temperature of thermally conductive liquid coupled thereto and extended therefrom for placement in the jacket. Lastly, a monitor is adapted to be coupled to the temperature probe, heating element, and pump for monitoring and controlling the temperature and flow of thermally conductive liquid disposed in the jacket, the monitor further having input circuitry for receiving electrical energy from an external power source, connection circuitry for allowing the temperature probe, heating element, and pump to be removably coupled thereto and activated, indication circuitry for providing a visual indication of operation, and selection circuitry for selectively activating the indication circuitry and temperature probe, heating element, and pump.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved temperature controlled thermal jacket which has all the advantages of the prior art cooling and heating apparatuses and none of the disadvantages.

It is another object of the present invention to provide a new and improved temperature controlled thermal jacket which may be easily and efficiently manufactured and marketed.

It is a further object of the present invention to provide a new and improved temperature controlled thermal jacket which is of durable and reliable construction.

An even further object of the present invention is to provide a new and improved temperature controlled thermal jacket which is susceptible of a low cost of manufacture with regard to both materials and labor, and which accordingly is then susceptible of low prices of sale to the consuming public, thereby making such a temperature controlled thermal jacket economically available to the buying public.

Still yet another object of the present invention is to provide a new and improved temperature controlled thermal jacket which provides in the apparatuses and methods of the prior art some of the advantages thereof, while simultaneously overcoming some of the disadvantages normally associated therewith.

Even still another object of the present invention is to provide a new and improved temperature controlled thermal jacket for collectively heating and cooling a refrigerant sealer for capturing refrigerant therefrom and transferring refrigerant thereto.

Lastly, it is an object of the present invention to provide a new and improved temperature controlled thermal jacket comprising a hollow and generally tubular jacket formed of a flexible material adapted to be coupled about a refrigerant container; fill means coupled to the jacket for filling the jacket with a thermally conductive liquid; a coil of thermally conductive tubing disposed within the jacket with the coil having an inlet and an outlet; and pump means coupled between the inlet and outlet of the coil for pumping thermally conductive liquid through the jacket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
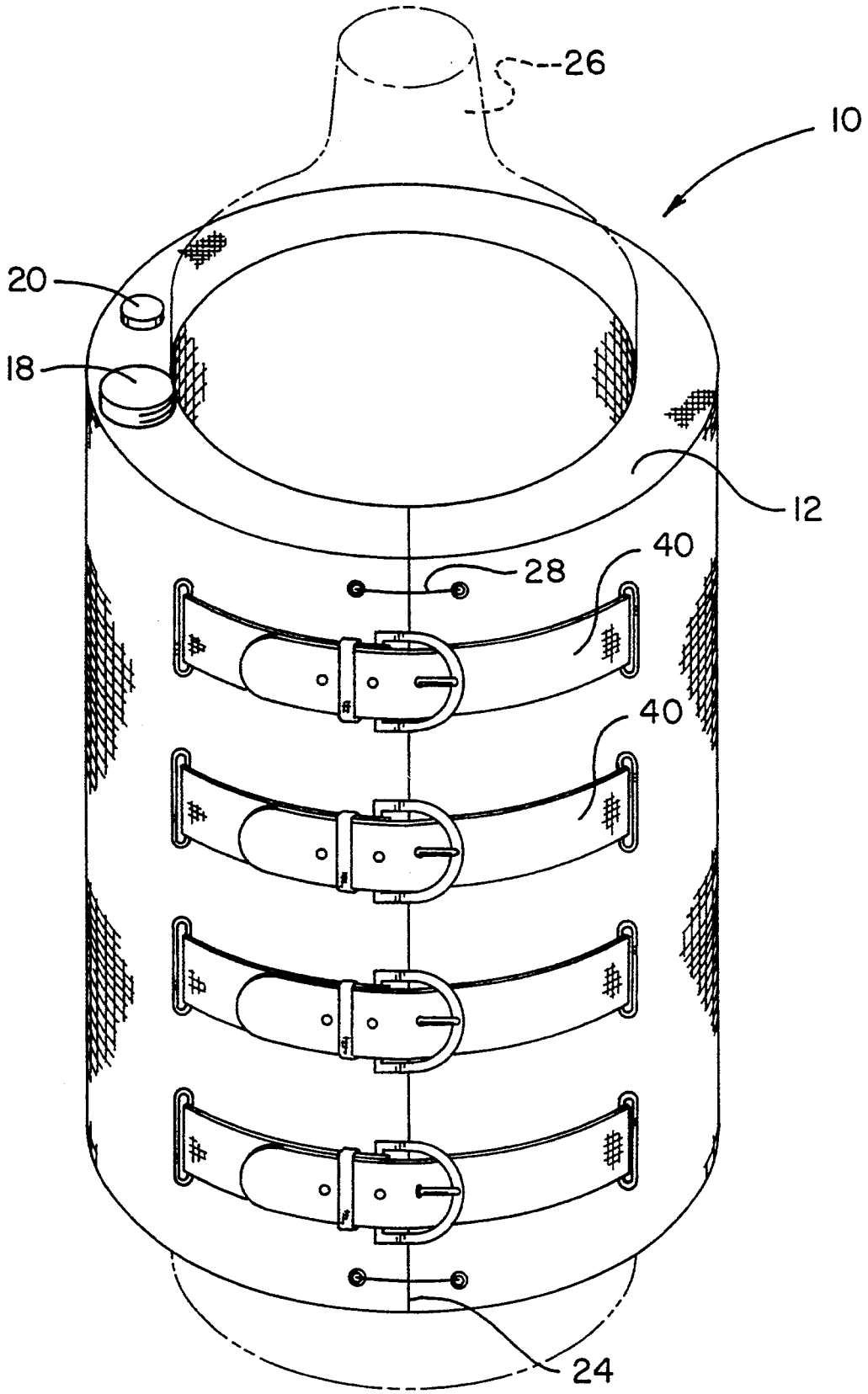
FIG. 1 is a perspective view of the preferred embodiment of the temperature controlled thermal jacket constructed in accordance with the principles of the present invention.
Figure 2:
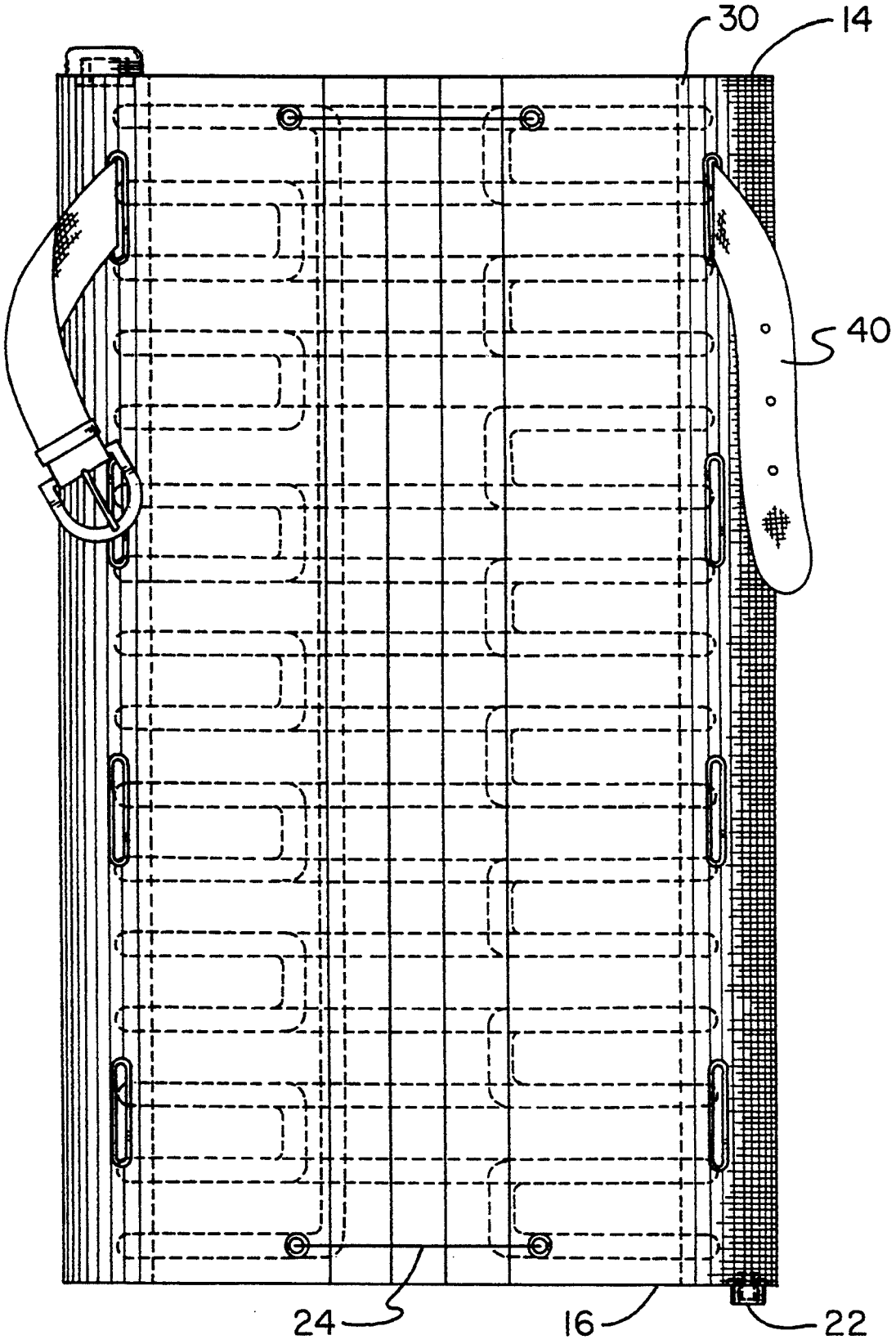
FIG. 2 is a side elevational view of the present invention depicting a coiled section of tubing therein for allowing transfer of heat within the jacket.
Figure 3:
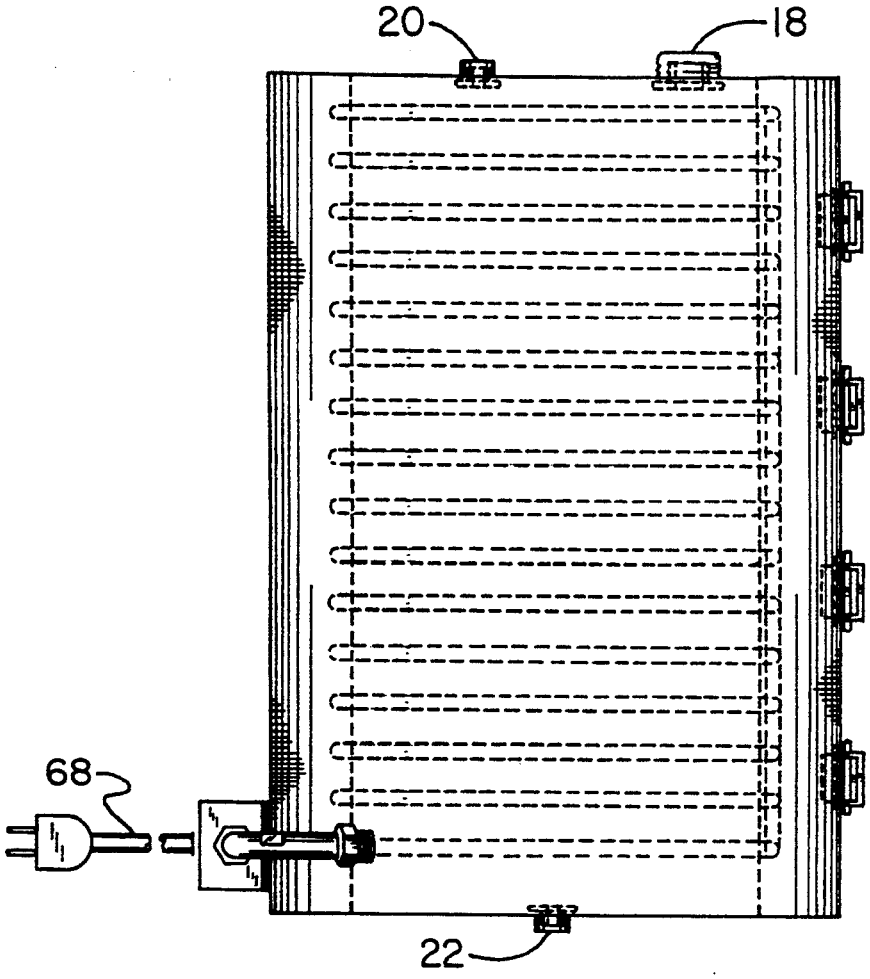
FIG. 3 is a side elevational view of the present invention depicting the coupling of the pump to the coiled section of tubing as well as the apertures in the jacket used for filling the jacket with thermally conductive liquid, venting the jacket, and draining the jacket.
Figure 4:
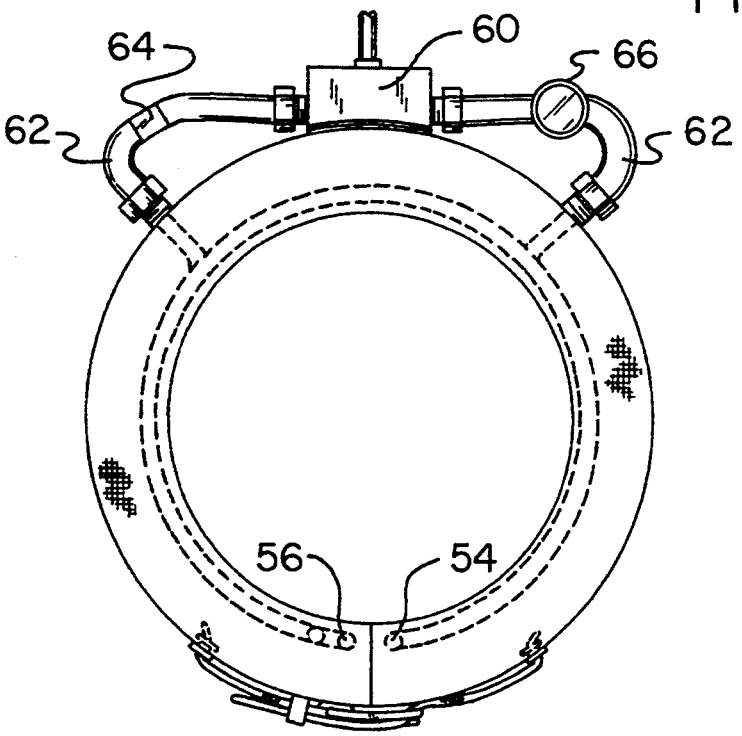
FIG. 4 is a planned view of the present invention depicting the coupling of the pump between the inlet and outlet of the coiled section of tubing.
Figure 5:
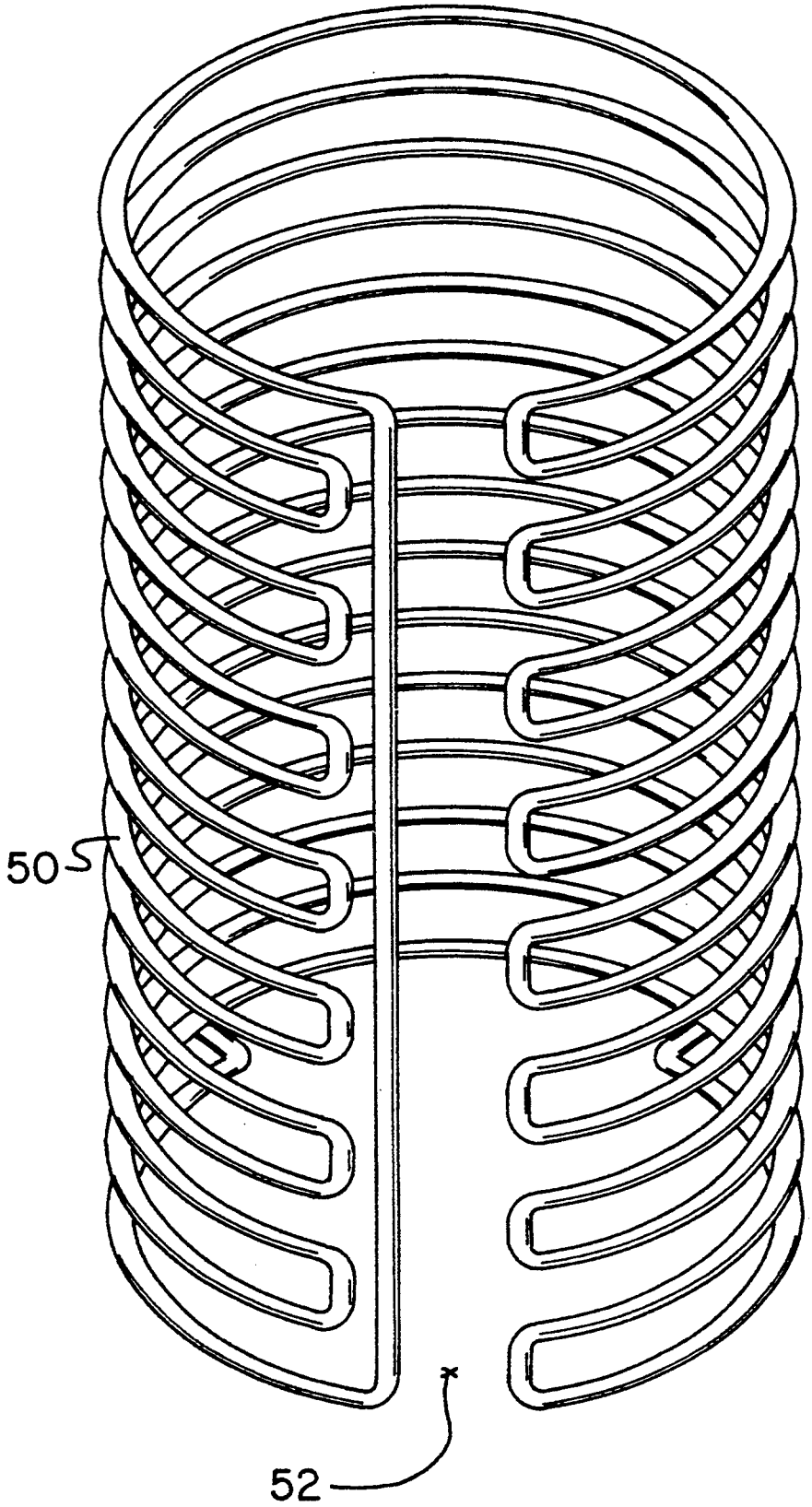
FIG. 5 is a perspective view of coiled section of tubing used for transferring heat within the jacket of the present invention.
Figure 6:
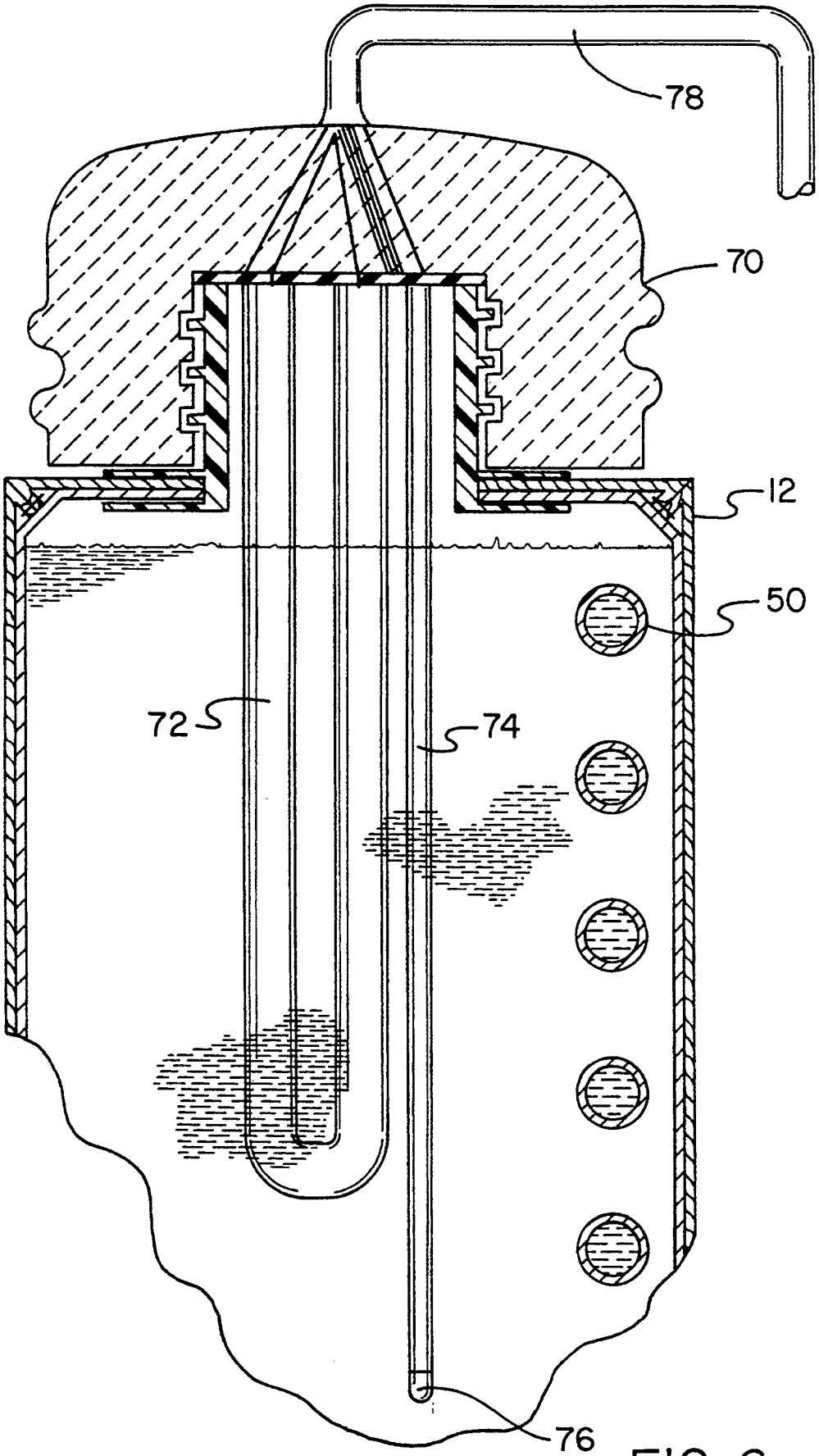
FIG. 6 is a cross-sectional view of the filling hole with a porcelain cap threadably coupled thereto and having a heating element and a temperature probe disposed within the jacket and in contact with the thermally conductive liquid, the heating element and temperature probe further having a terminal cable coupled thereto adapted for allowing a monitor to provide selective control thereof to heat or cool the liquid within the jacket.
Figure 7:
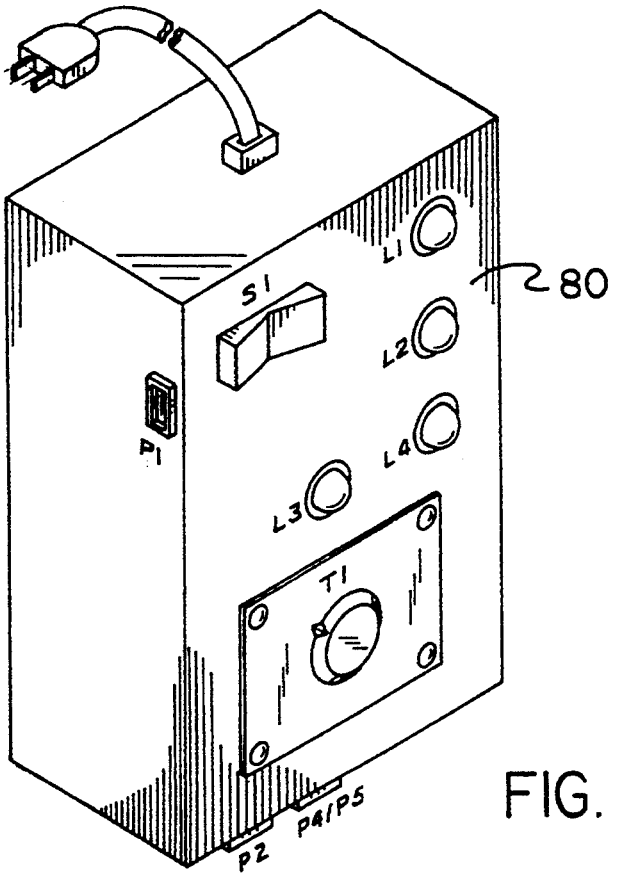
FIG. 7 is a perspective view of the monitor of the present invention for monitoring and controlling the temperature of the thermally conducted liquid in the jacket.

With reference now to the drawings, and in particular, to FIG. 1 thereof, the preferred embodiment of the new and improved temperature controlled thermal jacket embodying the principles and concepts of the present invention and generally designated by the reference number 10 will be described.

Specifically, the present invention includes seven major components. The major components are the jacket, support beams, belts, coil, pump, heater fill cap, and monitor. These components are interrelated to provide the intended function.

More specifically, it will be noted in the various Figures that the first major component is the jacket 12. The jacket is hollow and generally tubular in structure. It is formed of a canvas material. It is adapted for receiving a thermally conductive liquid therein. The jacket has an upper end 14, and a lower end 16. A fill hole is disposed on the upper end and secured with a removable fill cap 18. The fill hole is used for filling the jacket with the thermally conductive liquid. A vent hole is disposed on the upper end and secured with a removable vent cap 20. The vent hole is used for releasing pressure from within the jacket when filling with the thermally conductive liquid. A drain hole is disposed on a lower end and secured with a removable drain cap 22. The drain is used for draining the thermally conductive liquid from the jacket. An elongated slit 24 is formed on the jacket. It is adapted for allowing the jacket to be spread opened and wrapped around a refrigerant cylinder 26. A pair of spaced safety wires 28 are coupled across the slit. One of the wires is positioned near the upper end of the jacket and the other wire is positioned near the lower end of the jacket. The wires are used for limiting the spread of the jacket, thereby holding the jacket in a generally tubular configuration at all times.

The second major component is the support beams 30. The present invention includes a plurality of rigid aluminum support beams. The aluminum support beams are disposed within the jacket. They are secured within the jacket to provide stability and support the weight of the thermally conductive liquid.

The third major component is the belts 40. The present invention includes a plurality of spaced and adjustable belts. The belts are coupled to jacket across the slit 24. Each belt is adapted to be secured for ensuring a tight fit about a refrigerant cylinder disposed in the jacket. Each belt is secured with a buckle. A loop is coupled to each belt. Each loop is used for keeping the free end of each belt in an essentially secured position near the jacket.

The fourth major component is the coil 50. The coil is generally tubular-shaped. It is formed of a thermally conductive copper tubing. The coil is disposed within the jacket 12. The coil is wrapped in a configuration to define an elongated opening 52 along its tubular-shaped structure. This opening is positioned adjacent to and aligned with the slit 24 of the jacket. The coil is adapted to flex when the jacket is spread open and return to its original shape when released. It is allowed to flex such that a refrigerant cylinder may be disposed within the jacket. The coil has an inlet 54 positioned near the lower end of the jacket. The coil also has an outlet 56 positioned near the upper end of the jacket. Thermally conductive liquid travels from the inlet to the outlet of the coil. Depending on the operation desired by the user, the coil is adapted for uniformly distributing heated or cooled thermally conductive liquid throughout the jacket.

The fifth major component is the pump 60. The pump is coupled to the coil between the inlet 54 and outlet 56 thereof for receiving thermally conductive liquid for pumping. Flexible tubing 62 is extended from the ports of the pump to the inlets and outlets of the coil. One piece of flexible tubing has a site glass 64 formed thereon. A site glass allows a user to view the flow of thermally conductive liquid. A temperature gauge 66 may also be coupled to the tubing for providing a cursory temperature read out. The pump is adapted to be electrically energized through a power cable 68 for pumping thermally conductive liquid through the coil in the jacket.

The sixth major component is the heater fill cap 70. The heater fill cap is adapted to be removably secured to the fill hole in lieu of the fill cap. The heater fill cap is made of porcelain. The heater fill cap includes a heating element 72 for heating thermally conductive liquid extended therefrom. The heating cap also includes a temperature probe 74 for monitoring the temperature of thermally conductive liquid extended therefrom. Additionally, a high limit cut out 76 is coupled to the temperature probe as an auxiliary backup therefore. The high limit cut out is a switch that opens or closes based on a preselected temperature threshold. The temperature probe, heating element, and high limit cut out are positioned within the jacket when the heater fill cap is secured to the fill hole. The terminals of the heating element, temperature probe, and high limit cut out are extended upwards through the heater fill cap in a cable form terminated at a six pin connector plug.

The seventh major component is the monitor 80. The monitor is adapted to be coupled to the temperature probe 74, heating element 72 and pump 60 for monitoring and controlling the temperature and flow of thermally conductive liquid disposed within the jacket 12. The monitor has input circuitry 82 for receiving electrical energy from an external power source. The monitor has connection circuitry 84 for allowing the temperature probe, heating element, and pump to be removably coupled thereto and activated. The monitor has indication circuitry 86 for providing a visual indication of operation. The monitor also has sensing circuitry 88 for selectively activating the indication circuitry and temperature probe, heating element, and pump. The connection circuitry includes conventional electrical sockets for receiving the plug end of the pump power cable and a six pin connector for receiving the connector plug of the heater fill cap.

The present invention is used for sub-cooling and ultra heating of refrigerant cylinders for recovery jobs or re-charging of recovered or new refrigerants. For sub-cooling, the present invention can be used with thermally conductive liquid such as water, ice and water, or conventional and commercially available endothermic cooling compositions. Currently, conventional and commercially available endothermic cooling compositions require mixture with water in a 5 gallon bucket, which is adapted to accommodate a 30 pound refrigerant cylinder. Once this is done, however, there is not much room for the water to dissipate heat. Also, this method will not hold a 50 pound cylinder that is commonly used in refrigeration systems.

However, conventional and commercially available endothermic cooling compositions may be used in the present invention, which can accommodate a 50 pound refrigerant cylinder. Furthermore, by using the present invention more water and more endothermic cooling composition may be added to further lower water temperature. Once the present invention is turned on, the pump circulates the cold water from bottom to top in a open loop system sealed to outside air. It will hold the sub-cooled water much more efficiently than the bucket method currently used. If an endothermic cooling composition is not used, ice cubes or crushed ice can be used to drop water temperature down to 32 degrees F. This is temperature is sufficient for evacuating refrigerant from refrigerant cylinders. Furthermore, by not using the endothermic cooling compositions, there is no mess to clean up, no fumes, and no hassle.

For heating of a refrigerant cylinder, and recharging either liquid or hot gas, the heater fill cap and monitor can be added to the present invention using the same or new water. Once the heater fill cap is in place, screwed on and powered up, the pump will start circulating the heated water from the bottom to the top of the open loop system. The thermostat of the monitor can be set to a desired temperature. The pump can be plugged in an automatic pump outlet plug where the pump will only start when the water set temperature is reached. The pump will then shut off on the direction of the thermostat. The pump can also be plugged into an outlet plug allowing constant pump operation. The pump will operate as long as the system is energized. In this fashion, the present invention will allow for much faster charging of liquid gas. Recovery and recharging of refrigerants is accomplished by handling them when they are either in the liquid stage or the gaseous condition. This is done more efficiently if the storage cylinders are cooled or heated with the present invention during the process.

Two sizes of the present invention may be constructed—one for holding 30 pound refrigerant container, and the other for holding 50 pound refrigerant containers. Both jackets are reinforced with aluminum supports, and safety wire for added securing. Securement straps are used to secure the jacket about a cylinder. Only three securement straps are used on the smaller unit coupled around a 30 pound cylinder. The jacket is double walled, and for cooling is filled with proportions of commercially available chemical granules and water to produce an endothermic reaction which removes the heat from the tank. A pump and coil circulates the water from the bottom to the top to ensure uniformity of heat transfer. The coil is formed of ¼ inch copper tubing. The pump is secured to the periphery of the jacket with a pile type fastener. Hoses are extended from the pump and coupled to the inlet and outlet of the coil. Crushed ice and water can also be used in place of the solution. For heating, a heating unit is placed in the water filled jacket to raise the temperature to a level that is controlled by a thermostatic monitor. The pump may operate continuously, or in conjunction with the thermostat. Heating will speed up both the charging and recovery operations. The heating element is adapted to operate at 115 volts and 1250 watts at 11.2 amps. Terminal wires are coupled to the temperature probe and heating element and extended through the cap. An integral sleeve is disposed around these wires and terminated at a six port female connector. This connector is securable to a compact monitor. The monitor is plugged into standard household current for operation of the present invention. Indicator lamps show when the pump is operating and when the heater is off or on. A large dial is provided for the thermostat control. The monitor is adapted to be energized with a 115 volt external power supply.

Figure 8:
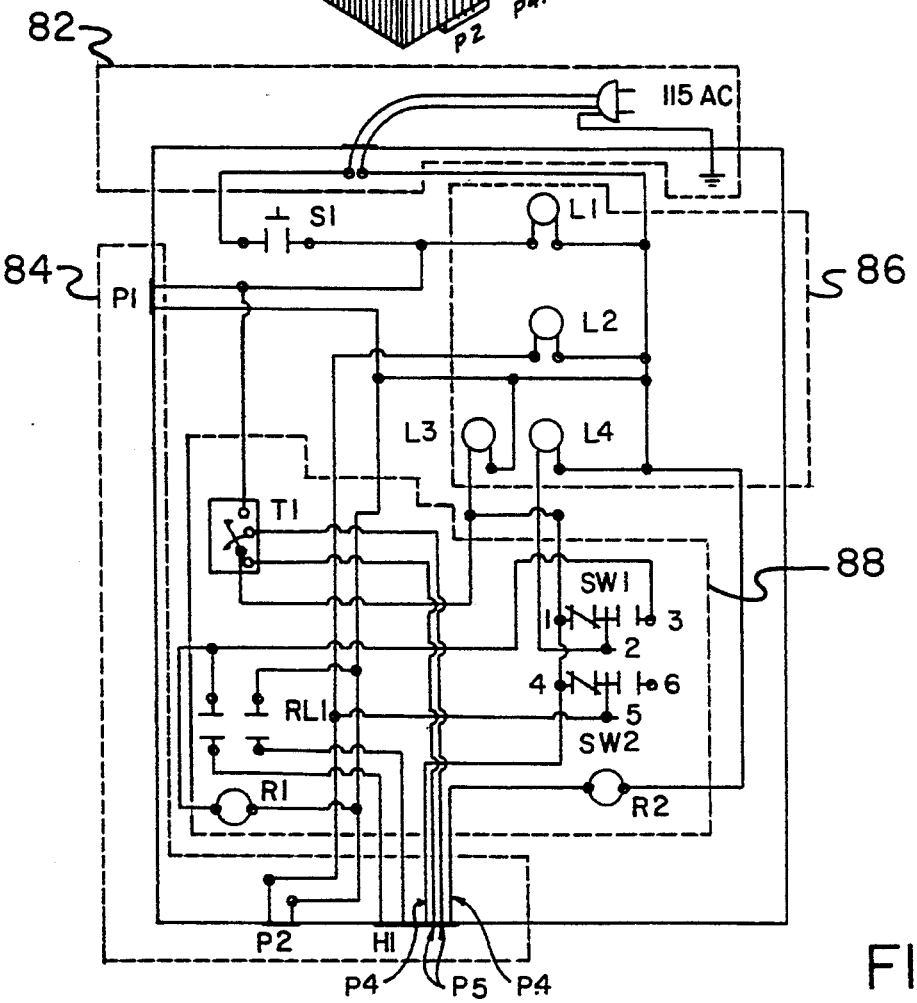
FIG. 8 is a schematic diagram of the monitor depicted in FIG. 7.

Referring to the monitor schematic diagram of FIG. 8, the pump is connected to the P1 plug when a user desires that the pump run constantly. The pump is connected to the P2 plug when a user desires that the pump be cycled based upon indications provided by the temperature probe and circuitry indicating a high limit cut out situation. The heating element is connected to the P4 plug. The temperature probe is connected to the P5 plug. Rocker switch S1 controls the activation or deactivation of a monitor. The green lamp L1 is activated when S1 is turned on. The green lamp L2 is activated when a pump connected to the P2 plug is turned on. Yellow lamp L3 is activated when the heating element connected to plug P4 is activated. The red lamp L4 is activated when a high limit indication signal is received from the temperature probe. Relay R2 is a 115 volt double pole double throw limit relay used for activating the thermostat switch SW1 having terminals numbered terminal 1, terminal 2, and terminal 3 and activating the limit switch SW2 with terminals denoted as terminal 4, terminal 5, and terminal 6. Thermostat T1 is used for monitoring the signals from the temperature probe. Thermostat T1 is adapted for allowing a temperature of up to 125 F to be set. Relay R1 is used for controlling the dual contacts of the comparator denoted as RL1. Switch S1 is a rocker switch for activating and deactivating the monitor. The heating element is connected through H1. Plug H1, plug P4, and plug P5 comprise the terminal plugs of the six pin connector.

Operation of the power supply of the auxiliary heating element operates as follows. Power is supplied through the 115 VAC power line when switch S1 is closed. Plug P1 is used to place the pump in a constant mode of operation when coupled thereto. When switch S1 is closed, a green power on lamp L1 is activated, designating that the power supply has been activated. Electrical energy is supplied from switch S1 to the thermostat T1. The pump operates constantly when connected through plug P1. The pump operates intermittently when connected through plug P3. The thermostat T1 controls the temperature of the liquid in the container. Thermostat T1 is normally closed when the specified temperature is not exceeded as registered through the temperature probe connected thereto via plug P5. Thermostat T1 is opened when the temperature is exceeded as registered through the temperature connected thereto via plug P5.

When the specified temperature is not reached, thermostat T1 is closed. The heat-on lamp L3 is activated. Terminal 1 and terminal 3 of the thermostat switch SW1 are closed via relay R2, thereby deactivating L4, and closing the contacts of the two pull contactor RL1, and activating the heating element connected through the plug H1. Furthermore, Terminal 4 and terminal 6 (leaving 5 opened) of the limit switch SW2 are closed relay R2, and thereby deactivating a pump connected through P3 and deactivating green pump-on lamp L2. Thus, water is heated without the pump being activated.

When the temperature is exceeded, thermostat T1 is opened. The heat-on lamp L3 is deactivated. Terminal 1 and terminal 2 of the thermostat switch SW1 are closed, whereby activating L4, opening the contacts of the two pull contactor RL1 via relay R1, thus deactivating the heating element connected through the plug H1. Furthermore, Terminal 4 and terminal 5 of the limit switch SW2 are closed via relay R2, and thereby activating a pump connected to through P3 and activating the pump-on lamp L2. Thus, the heating element is deactivated and the pump is activated.

The high-limit cut out device is used as an auxiliary back-up to the temperature probe. When the high limit cut out device is activated, terminal 1 and terminal 2 of the thermostat switch SW1 are closed via relay R2, thereby deactivating lamp L2 and activating lamp L4, opening the contacts of the two pull contactor RL1 via relay R1, thus deactivating the heating element connected through the plug H1. Furthermore, Terminal 4 and terminal 5 of the limit switch SW2 are closed via relay R2, and thereby activating a pump connected to through P3 and activating the pump-on lamp L2. Thus, the heating element is deactivated and the pump is activated.

Up until recently, many refrigerant transfers were considered unnecessary. The cost of refrigerants was relatively low, so in many cases the refrigerant gas was simply allowed to escape into the atmosphere when repairs were necessary. However, in recent years, environmentalists and scientists have called the world's attention to the alarming depletion in the ozone layer above our planet. Since the layer protects the inhabitants from the very harmful rays of the sun and controls the temperatures we experience, there is great concern over global warming and other problems. The depletion is caused by the gases which are released into the atmosphere from vehicles and other sources. Fluorocarbons, in particular, have a devastating effect on the ozone so serious steps have been taken to discourage and to eventually eliminate their use entirely. Taxation has increased the cost for substances like freon to outrageous levels making it very desirable to recover every bit of the gas whenever possible. Furthermore, in today's high-tech market and with new requirements for refrigerant recovery and no bleed off of refrigerant to the atmosphere. Therefore, the present invention could be used by service companies and service technicians, whether in house or out in the field to help in the refrigerant recovery process.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A temperature controlled thermal jacket for selectively heating and cooling a refrigerant cylinder for capturing refrigerant therefrom and transferring refrigerant thereto comprising, in combination:

a hollow and generally tubular jacket formed of a canvas material for receiving a thermally conductive liquid therein, the jacket having an upper end, a lower end, a fill hole disposed on the upper and secured with a removable fill cap, a vent hole disposed on the upper end and secured with a removable vent cap, a drain hole disposed on the lower end and secured with a removable drain cap, an elongated slit formed therethrough for allowing the jacket to be spread open and wrapped around a refrigerant cylinder, and a pair of spaced safety wires coupled across the slit for limiting the spread of the jacket;

a plurality of rigid aluminum support beams disposed within the jacket to provide it stability;

a plurality of spaced and adjustable belts coupled to the jacket across the slit thereof with each belt adapted to be secured for ensuring a tight fit about a refrigerant cylinder disposed therein;

a generally tubular-shaped coil of thermally conductive copper tubing disposed within the jacket with the coil wrapped in a configuration to define an opening positioned adjacent to the slit of jacket, the coil adapted to flex when the jacket is spread open, the coil having an inlet positioned near the lower end of the jacket and an outlet positioned near the upper end of the jacket;

a pump coupled to the coil between the inlet and outlet thereof and secured to the jacket with a pile type fastener with the pump adapted to be electrically energized for pumping thermally conductive liquid through the jacket;

a removable porcelain heater fill cap adapted to be secured to the fill hole in lieu of the fill cap, the heater fill cap having a heating element for heating thermally conductive liquid and a temperature probe for monitoring the temperature of thermally conductive liquid coupled thereto and extended therefrom for placement in the jacket; and a monitor adapted to be coupled to the temperature probe, heating element, and pump for monitoring and controlling the temperature and flow of thermally conductive liquid disposed in the jacket, the monitor further having input circuitry for receiving electrical energy from an external power source, connection circuitry for allowing the temperature probe, heating element, and pump to be removably coupled thereto and activated, indication circuitry for providing a visual indication of operation, and selection circuitry for selectively activating the indication circuitry and temperature probe, heating element, and pump.

2. A thermal jacket for selectively heating and cooling a refrigerant container for capturing refrigerant therefrom and transferring refrigerant thereto comprising:

a hollow and generally tubular jacket formed of a flexible material adapted to be coupled about a refrigerant container;

fill means coupled to the jacket for filling the jacket with a thermally conductive liquid;

a coil of thermally conductive tubing disposed within the jacket with the coil having an inlet and an outlet; and pump means coupled between the inlet and outlet of the coil for pumping thermally conductive liquid through the jacket.

3. The thermal jacket as set forth in claim 2 further including:

a removable heater fill cap adapted to be coupled to the fill means, the heater fill cap having a heating element for heating thermally conductive liquid and a temperature probe for monitoring the temperature of thermally conductive liquid coupled thereto and extended therefrom for placement in the jacket; and a monitor adapted to be coupled to the temperature probe, heating element, and pump means for monitoring and controlling the temperature and flow of thermally conductive liquid disposed in the jacket.

4. The thermal jacket as set forth in claim 2 further including support means disposed within the jacket to provide it stability.

5. The thermal jacket as set forth in claim 2 further including a plurality of spaced and adjustable belts coupled to the jacket for ensuring a tight fit about a refrigerant container.

6. The thermal jacket as set forth in claim 2 further including vent means coupled to the jacket for releasing pressure in the jacket due to filling.

7. The thermal jacket as set forth in claim 2 wherein the pump means is secured to the jacket with a pile type fastener.

* * * * *